US008267344B2

(12) United States Patent
Maddaleni et al.

(10) Patent No.: US 8,267,344 B2
(45) **Date of Patent: *Sep. 18, 2012**

(54) METHOD AND DEVICE FOR PRODUCING LOGS OF WEB MATERIAL WITH A MECHANISM FOR INTERRUPTING THE WEB MATERIAL ACTIVATED BY PASSAGE OF THE WINDING CORES

(75) Inventors: Romano Maddaleni, Bientina (IT); Angelo Benvenuti, Lucca (IT); Roberto Morelli, Lucca (IT)

(73) Assignee: Fabio Perini S.p.A., Lucca (IT)

( * ) Notice: Subject to any disclaimer, the term of this patent is extended or adjusted under 35 U.S.C. 154(b) by 0 days.

This patent is subject to a terminal disclaimer.

(21) Appl. No.: 12/227,626

(22) PCT Filed: Jun. 4, 2007

(86) PCT No.: PCT/IT2007/000390

§ 371 (c)(1),
(2), (4) Date: Nov. 24, 2008

(87) PCT Pub. No.: WO2007/141819

PCT Pub. Date: Dec. 13, 2007

(65) Prior Publication Data

US 2009/0173819 A1 Jul. 9, 2009

(30) Foreign Application Priority Data

Jun. 9, 2006 (IT) ..... FI2006A0140

(51) Int. Cl.
*B65H 19/28* (2006.01)

(52) U.S. Cl. ..... 242/532.1; 242/532.2; 242/532.3; 242/533

(58) Field of Classification Search ..... 242/533, 242/532.1–532.3, 535.4, 541.3, 526.1
See application file for complete search history.

(56) References Cited

U.S. PATENT DOCUMENTS

| | | | | |
|---|---|---|---|---|
| 5,681,421 | A * | 10/1997 | Biagiotti | 156/446 |
| 5,853,140 | A * | 12/1998 | Biagiotti | 242/534 |
| 5,979,818 | A * | 11/1999 | Perini et al. | 242/521 |
| 6,029,927 | A * | 2/2000 | Wohlfahrt et al. | 242/527.2 |
| 6,948,677 | B2 * | 9/2005 | Biagiotti et al. | 242/521 |
| 7,175,127 | B2 * | 2/2007 | Butterworth et al. | 242/542.1 |
| 7,318,562 | B2 * | 1/2008 | Biagiotti et al. | 242/521 |
| 2004/0061021 | A1 * | 4/2004 | Butterworth | 242/521 |
| 2004/0178295 | A1 * | 9/2004 | Betti et al. | 242/533 |
| 2009/0272835 | A1 * | 11/2009 | Benvenuti et al. | 242/521 |

FOREIGN PATENT DOCUMENTS

| | | | |
|---|---|---|---|
| EP | 0 524 158 | B1 | 3/1994 |
| EP | 0 454 633 | B1 | 9/1994 |
| GB | 1 435 525 | A | 5/1976 |
| GB | 2 105 688 | A | 3/1983 |
| WO | WO 96/32350 | A1 | 10/1996 |
| WO | WO 2004/005173 | A1 | 1/2004 |

* cited by examiner

*Primary Examiner* — Sang Kim
(74) *Attorney, Agent, or Firm* — Breiner & Breiner, LLC

(57) ABSTRACT

The rewinding machine includes: a winding unit; a feed path of the web material; an insertion path of the winding cores; a separator device to sever the web material upon completion of winding each log. The separator device is disposed and produced to be activated by passage of a winding core.

33 Claims, 8 Drawing Sheets

METHOD AND DEVICE FOR PRODUCING LOGS OF WEB MATERIAL WITH A MECHANISM FOR INTERRUPTING THE WEB MATERIAL ACTIVATED BY PASSAGE OF THE WINDING CORES

TECHNICAL FIELD

The present invention relates to methods and machines for producing logs of web material. More specifically, although not exclusively, the present invention relates to methods and machines for producing tissue paper, for example rolls of toilet paper, kitchen towels or the like.

STATE OF THE ART

To produce rolls of web material, for example kitchen towels, toilet paper or the like, rewinding machines are used. These machines are fed with a web material, formed by one or more plies of tissue paper or the like, unwound from a reel of large diameter. Predefined quantities of web material are wound on winding cores to form logs, the axial length of which is equivalent to the width of the web material fed to the rewinding machine and many times greater than the axial length of the small finished rolls intended for use. These logs are subsequently cut into individual rolls of the desired dimension, which are subsequently packaged.

Modern rewinding machines work continuously, i.e. with feed of the web material at substantially constant speed. Substantially constant is intended as a speed that does not require to be substantially modified upon completion of winding a log and before starting to wind the subsequent log, i.e. during the exchange step.

The exchange step performed upon completion of winding each log is a step in which the web material is severed (preferably along a transverse perforation line) to form a final edge that finishes winding around the completed log, and an initial edge that must be transferred to a new winding core to give rise to forming a subsequent log.

To sever the web material various devices are known, which are normally activated by an actuator to perform severing of the web material upon completion of winding each log, forming an initial edge and a final edge, controlled in synchronism with other members of the rewinding machine.

For example, U.S. Pat. No. 5,979,818, U.S. Pat. No. 5,7689,352 and U.S. Pat. No. 5,853,140 describe rewinding machines in which the web material is severed between a completed log and the new core, during insertion into a channel, by means of a severing member or separator device that acts on the web material, cutting or tearing it. This separator device is moved by a motor synchronized with the other parts of the rewinding machine and in particular with the system for insertion of the cores.

In other known devices (GB-A-1,435,525) severing of the web material takes place with pressurized air jets synchronized with insertion of the cores into the winding area. In U.S. Pat. No. 4,487,377 and in EP-A454633 the web material is cut upon completion of winding each log by means of a knife or a blade activated in synchronism with insertion of the new winding core.

U.S. Pat. No. 5,137,225 describes a rewinding machine in which the web material is torn as a result of cooperation between a new core inserted into an insertion channel and a fixed surface, the core pinching the web material against the fixed surface and consequently causing a tension exceeding the breaking point of the web material.

GB-A-2,105,688 and EP-A-524158 describe rewinding machines in which the web material is torn by acceleration of one or the winding rollers forming the winding cradle.

Timing the action of the separator device with the other members of the rewinding machine to obtain tearing, cutting or in general severing of the web material, in a predetermined instant is a constructionally complex and delicate aspect.

OBJECTS AND SUMMARY OF THE INVENTION

An object of an embodiment of the invention is to provide a method and a machine which, with means that are simple, inexpensive and easy to control, make it possible to obtain severing of the web material correctly timed, i.e. synchronized, with the insertion of the winding cores upon completion of each log forming cycle.

According to a possible embodiment, the method of the present invention provides that upon completion of winding a log the web material is severed to form a final edge which is wound around the log and an initial edge which is wound around a new winding core inserted in an insertion path, in which the web material is severed by means of a separator device, which is controlled directly by passage of the new winding core along the insertion path. In substance, according to a possible embodiment, the separator device is a passive member, which is activated by the thrust of the winding core during the movement thereof. According to a different embodiment, the separator device can be activated indirectly by passage of the core, for example by means of a sensor that detects passage of the core in a specific position of the path thereof and generates an activation signal (by means of a suitable actuator) of the separator device. Activation to cause severing of the web material can be caused by the thrust of the core being fed, while an actuator causes withdrawal of the separator device when the core must move beyond said device towards the winding unit or winding cradle.

According to a possible embodiment the method according to the invention includes the steps of:

- feeding the winding core along an insertion path;
- providing along said insertion path a control element constrained to the separator device;
- making the core interact with the control element during feed thereof along the insertion path, to activate the separator device and cause severing of the web material.

In substance, the invention is based on the principle of activating the separator device not by means of an actuator to synchronize with the other members of the machine through a specific controller, but by making the core interact directly with the separator device which is in substance a passive device. Passive device is intended, within the scope of the present description, as a device without an actuator thereof, which is controlled by passage of the core in a specific position along the insertion path thereof.

According to a particular embodiment of the invention, the method comprises the steps of:

- providing a rolling surface for the cores;
- providing a movable guide member for the web material, which defines together with the rolling surface a channel for insertion of the cores, in which the web material is fed in contact with the guide member;
- upon completion of winding a log, inserting a new winding core in the channel, in contact with the web material and with the rolling surface;
- feeding the winding core along the channel;

making the winding core interact with the separator device along the channel, movement of the winding core causing the action of said separator device on the web material.

In a possible embodiment of the invention, after severing of the web material continuation of feed of the core along the insertion path thereof causes temporary withdrawal of the separator device with respect to the insertion path to allow passage of the winding core.

In a possible embodiment of the invention, by interacting with the separator device the core pushes this device against the web material causing pinching of the web material between the separator device and the guide member. The latter can be formed by a belt or another flexible element, an assembly of belts parallel to one another, or the like, with which the web material is in contact. The feed speed of the web material is substantially the same as, with the exception of acceptable slipping, the feed speed of the guide device or member. In a different embodiment the guide member can be constituted by one of the winding rollers that define the winding cradle of a peripheral or surface rewinding machine.

The separator device can be rotatingly or oscillatingly supported about an axis of oscillation or rotation and the core with the passage thereof along the insertion path causes oscillation of the separator device against the web material to cause tearing or severing thereof.

Severing preferably takes place along a perforation line. Alternatively, severing can take place where there is no perforation, for example using a sharp or toothed blade.

The separator device can be maintained in an idle position by means of a counterweight or, according to a preferred embodiment of the invention, by means of a resilient member, for example a mechanical spring, a pneumatic spring (such as a pneumatic piston-cylinder system) or by means of another suitable device. The separator device is operated, i.e. taken td the operating position to cooperate with the web material, as a result of the thrust exerted thereon by the core fed along the insertion path thereof. The separator device can advantageously have a second withdrawn position with respect to the feed path of the core, thereby allowing the core to be fed freely and without obstruction along the path to the log forming area.

According to a different aspect, in a preferred embodiment of the invention there is provided a rewinding machine for producing logs of web material wound around a winding core comprising:

a winding unit;

a feed path of a web material;

an insertion path of the winding cores;

a separator device to sever the web material upon completion of winding each log, arranged and designed to interact with a winding core in the insertion path and to be activated by said core during passage along said path.

According to a different embodiment, the invention relates to a method for producing logs of web material around the winding core, comprising the steps of:

winding a first log of web material in a winding cradle;

upon completion of winding said first log, feeding a new winding core towards the winding cradle;

making the new winding core, which is fed towards the winding cradle, interact with a separator device to sever the web material to form a final edge that is wound on the log and an initial edge intended to be fastened to the new winding core;

winding a second log of web material around said new winding core.

Also forming the object of the invention is a rewinding machine comprising in combination:

a winding cradle a feed path of the web material towards the winding cradle;

an insertion path of winding cores towards the winding cradle a separator device to sever the web material upon completion of winding;

According to the invention, the separator device is advantageously disposed along the insertion path of the cores and is produced and disposed to act in combination with the winding cores during passage thereof along said insertion path, so that the winding cores activate the separator device to cause severing of the web material. More specifically, according to a specific aspect of the present invention, the winding cores exert a thrust on the separator device while they roll along an insertion channel. This thrust activates the separator device, causing it to sever the web material.

According to a different aspect, the invention relates to a rewinding machine comprising in combination:

a winding cradle a feed path of the web material towards the winding cradle;

an insertion path of winding cores towards the winding cradle;

a separator device to sever the web material upon completion of winding a log, which interferes with the insertion path of the cores, so that passage of the cores along said insertion path causes movement of the separator device and the tearing or severing action thereof on the web material.

Further characteristics, embodiments and advantages of the method and of the device according to the invention are indicated hereunder with reference to some examples of embodiment illustrated in the accompanying drawings.

BRIEF DESCRIPTION OF THE DRAWINGS

The invention will be better understood by following the description and accompanying drawing, which shows practical non-limiting embodiments of the invention. More specifically, in the drawing, where the same or equivalent parts are indicated with the same reference numbers.

DETAILED DESCRIPTION OF SOME EMBODIMENTS OF THE INVENTION

Figure 1A:
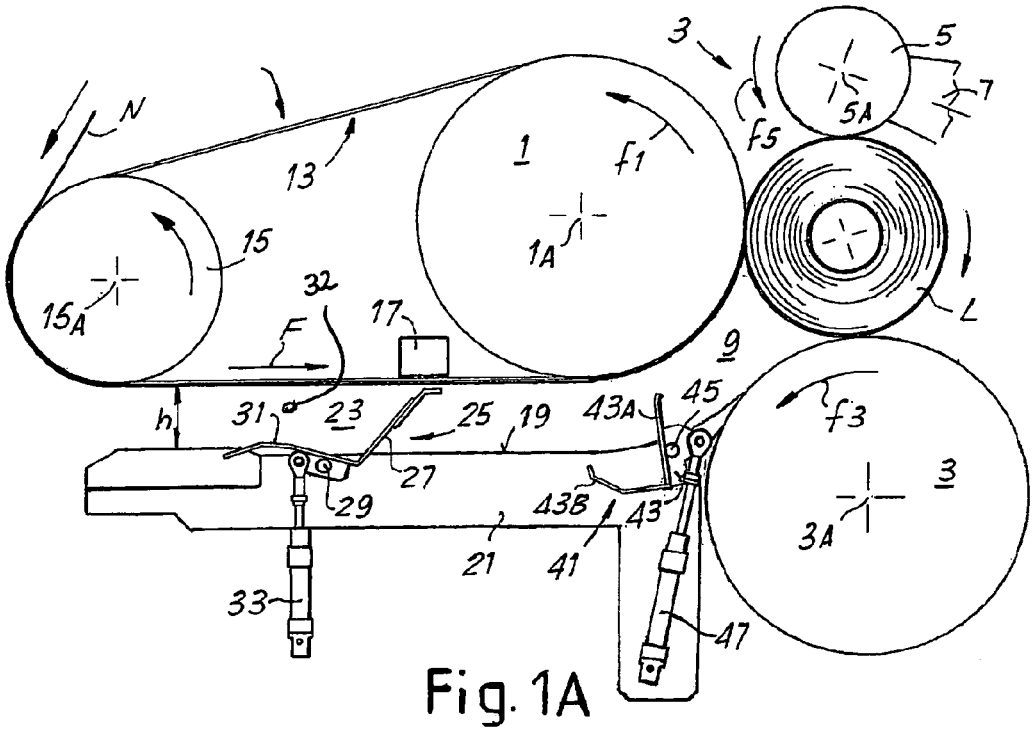
FIGS. 1A to 1F show a first embodiment of the invention in an exchange operating sequence.

The accompanying figures show the members of the rewinding machine in different embodiments of the invention, limited to those parts of the machine that are necessary in order to understand the principle on which the invention is based. Other parts of the machine can be designed in a manner known per se to those skilled in the art and, for example, in particular as described in the publications mentioned in the introductory part of this description, the content of which is fully incorporated herein. More specifically, the operating sequence illustrated in the figures of the drawing show the members of the winding head, i.e. those members used to feed the web material and to insert the cores, as well as to sequentially form the individual logs of web material around the respective tubular cores.

With initial reference to FIGS. 1A to 1F, 3 and 4, the rewinding machine, indicated as a whole with 1, comprises a winding unit 3 including: a first winding roller 1 rotating in the direction of the arrow f1 about an axis of rotation 1A; a second winding roller 3 rotating according to the arrow f3 about an axis of rotation 3A; a third winding roller 5, rotating in the direction of the arrow f5 about an axis 5A. The number 7 indicates an oscillating arm that allows the roller 5 to move so that the log L that is in the winding cradle defined by the rollers 1, 3 and 5 can increase in diameter to the final dimension.

Between the rollers 1 and 3 a nip 9 is formed, through which the web material N passes (for example a cellulose web material, such as a sheet of tissue paper), which is fed through a perforator unit (not shown) that generates a series of transverse perforation lines to divide the web material N into individual sections or sheets which, in the final using step, can be detached individually.

The web material N is fed along a feed path that extends partly around a winding roller 1 as well as adhering to a movable guide member 13 formed, in this embodiment, by a belt or by a series of belts parallel to one another suitably supported by sliding surfaces or shoes. The belts forming the guide member 13 of the web material N are fed around the winding roller 1, preferably housed in respective annular grooves, and around a roller 15 rotating about an axis 15A approximately parallel to the axis 1A of the roller 1 with a peripheral speed approximately the same as the peripheral speed of the winding roller 1 and as the feed speed of the web material N. This speed preferably remains approximately unchanged during the winding cycle and in particular during the exchange step.

Between the rollers 1 and 15, inside the path defined by the belts forming the guide member 13, there is disposed a fixed counter element 17 which can have sliding and guide grooves for the belts forming the guide member 13.

Figure 3:
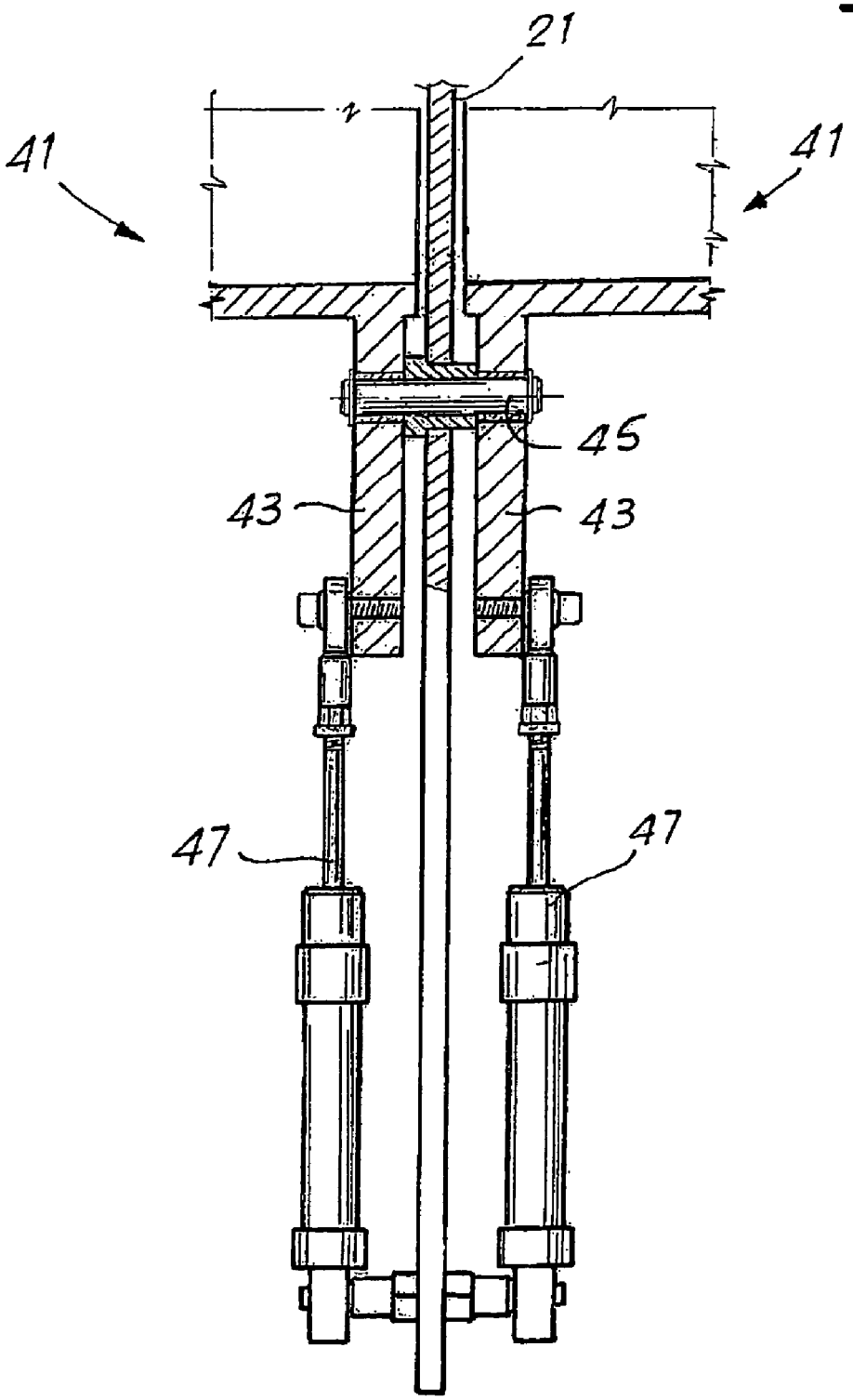
FIG. 3 shows a section indicatively according to the line III-III in FIG. 2B.
Figure 4:
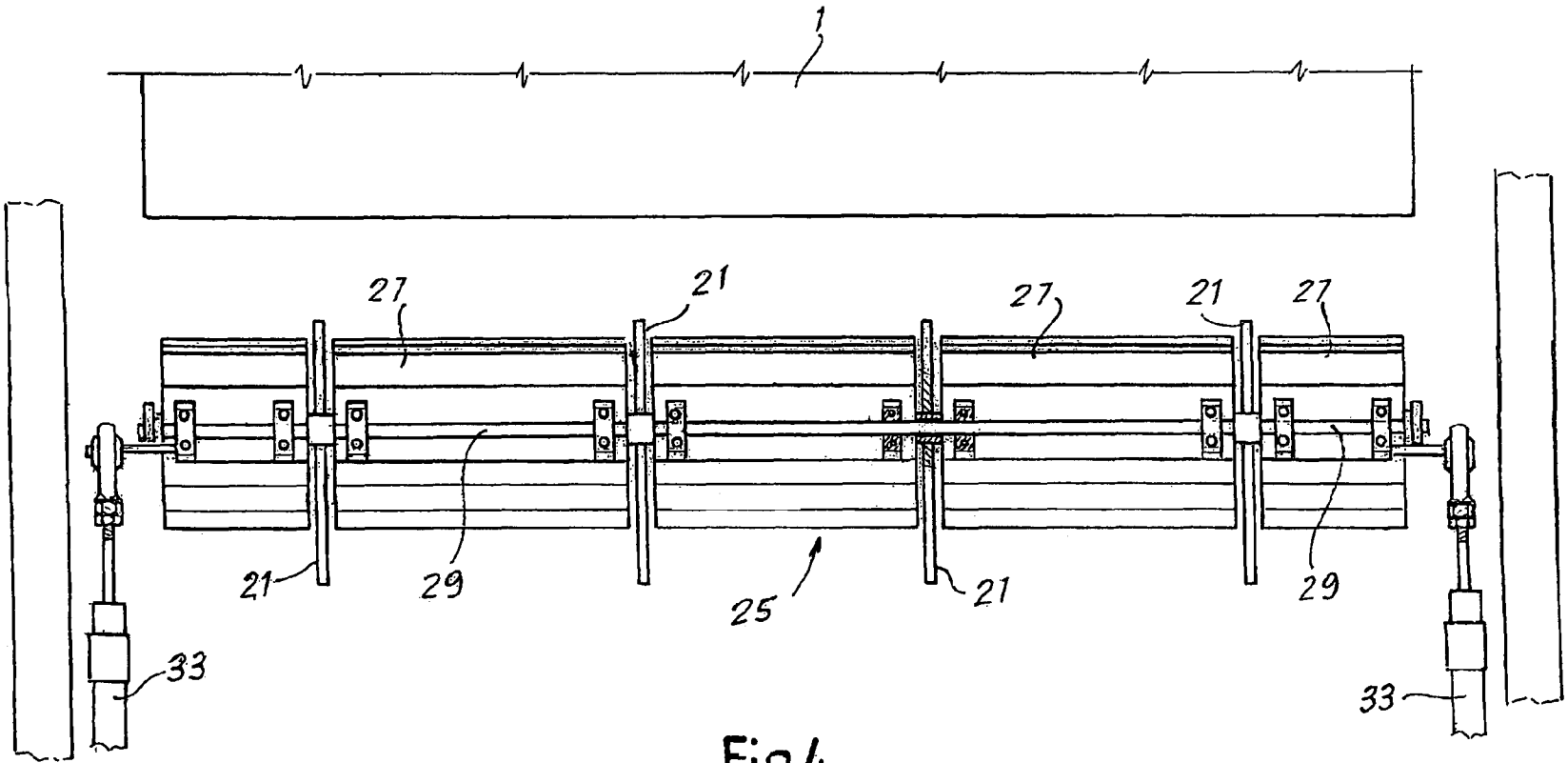
FIG. 4 shows a section indicatively according to IV-IV in FIG. 2A.

In front of the lower branch of the guide member 13 there extends a rolling surface 19 formed by a series of sections 21 parallel to one another and relatively thin, as shown by way of example in FIGS. 3 and 4. In these figures there are visible sections 21 forming the rolling surface 19. The individual sections 21 extend inside annular grooves in the roller 3 to form therewith a substantially continuous rolling surface of the winding core inserted in the machine each time. The rolling surface 19 defines, with the lower branch of the movable guide member 13, a channel 23 for insertion of the cores, said channel having in the entry area a slightly lower height h than the height of the remaining part of the channel, so as to cause elastic deformation of the winding core inserted each time by means of insertion members, not shown. In fact, the height h is lower than the external diameter of the winding core. The remaining part of the channel 23 is also slightly lower with respect to this external diameter to maintain the various winding cores firmly in contact with the rolling surface 19 and with the web material N fed along the feed path in contact with the belts forming the guide member 13.

In an intermediate position along the extension of the channel 23 a separator device 25 is arranged, which is used to sever the web material N upon completion of winding each log. The separator device is shown in a schematic front view in FIG. 4. It is formed by a plurality of pressers 27 hinged about a common axis 29 which extends transversely, approximately at 90°, with respect to the direction of feed of the web material N along the lower branch of the guide member 13. The pressers 27 preferably have an elastic structure and form part of substantially L-shaped brackets, extending on the opposite side with respect to the axis of oscillation 29 in shaped projections 31 that project inside the channel 23 upstream of the axis of oscillation 29 with respect to the direction of feed of the web material N (arrow F) and of the cores along the channel 23. Reference number 33 indicates a piston-cylinder actuator, which can also be replaced by a different member for moving and angularly controlling the separator device 25 in synchronism with the movement of the core, which normally maintains the separator device 25 in the arrangement shown in FIG. 1A. For example, an electronically controlled electric motor can be used, preferably aligned with the axis of oscillation of the separator device 25. Activation of the actuator 33 (whether this is a piston cylinder actuator, an electric motor or another device) can be caused by passage of the core, for example by means of a sensor that detects passage of the core in a specific position. FIG. 1A schematically indicates with 32 a sensor having this function. This can be an optical sensor, a photocell, a microswitch or the like. The sensor 32 can be used to control oscillation of the device counter-clockwise (in the drawing), in order to obtain severing of the web material and/or clockwise (again with reference to the drawing) to allow travel of the core after cutting or severing of the web material. In this way the need to use the core directly as actuating member of the oscillating movements of the device 25 is reduced or eliminated. In any case, however, control of severing of the web material is obtained as a consequence of travel of the core in a specific point or area of the insertion path thereof, without the need to synchronize the severing device with other mechanical members of the machine, as occurs in more complex rewinding machines.

In a preferred embodiment, a simple elastic member can be used (such as a pneumatic spring constituted by a piston-cylinder system 33), which constrains the separator device 25 in an idle position, the activation movement being controlled entirely by passage of the core. A shock absorber can be combined with the elastic member to dampen the return movement of the separator device 25, after the core A has moved beyond this device (passage from FIG. 1D to FIG. 1E).

Figure 2A:
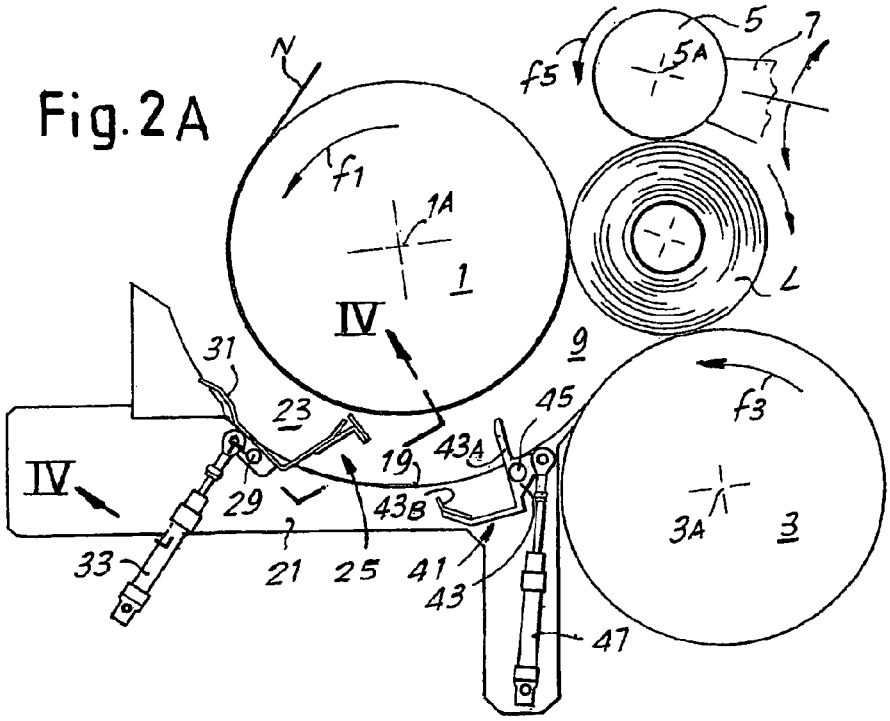
FIGS. 2A to 2F show an operating sequence of a second embodiment of the invention.
Figure 2B:
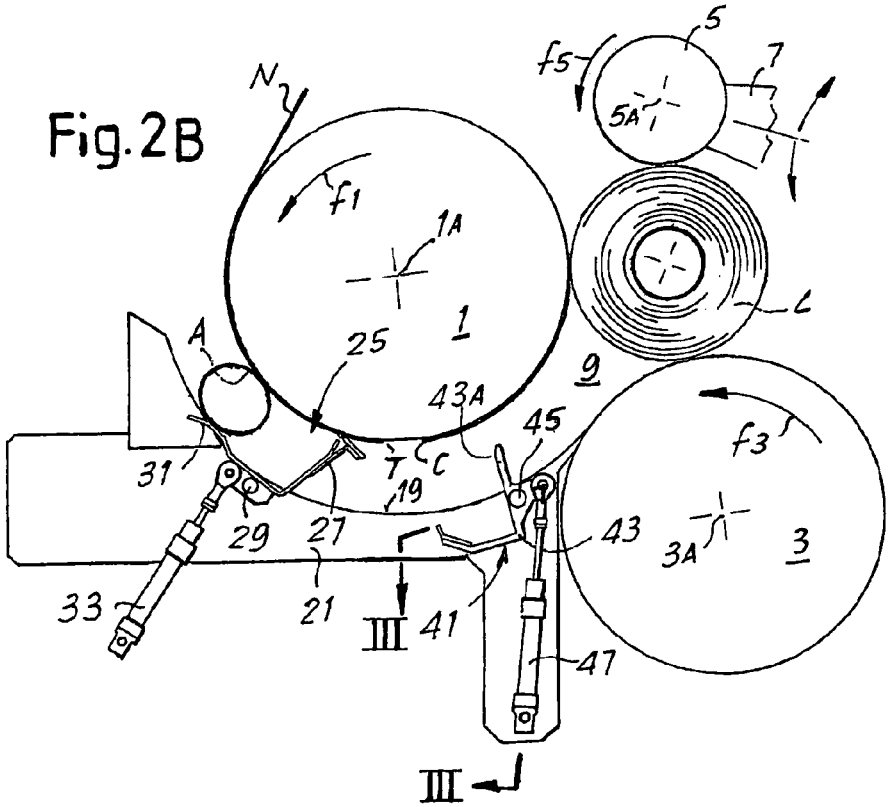
Figure 2C:
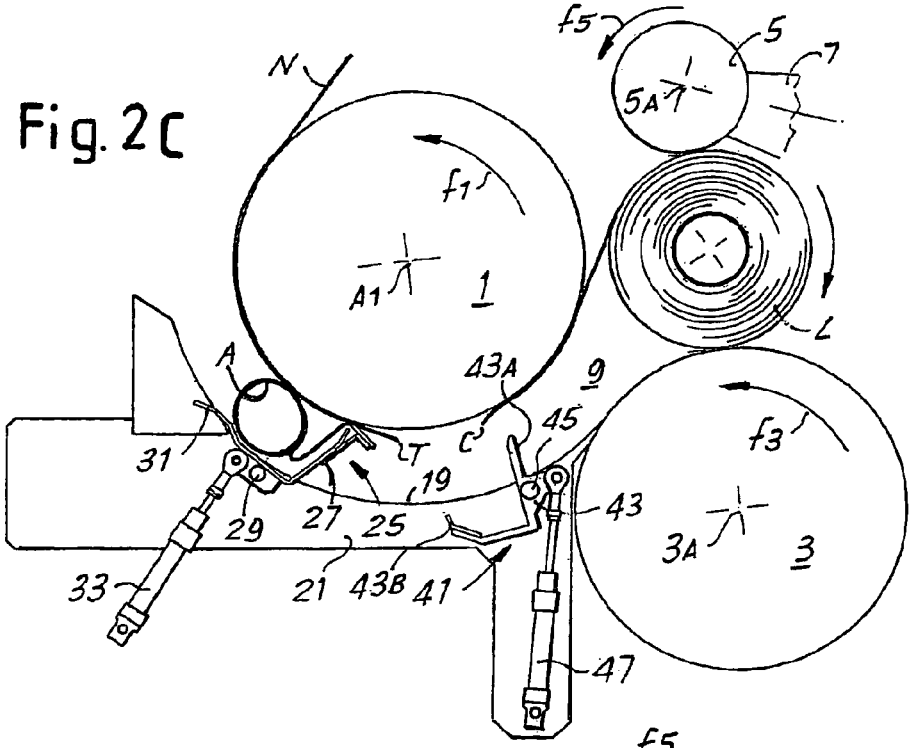
Figure 2D:
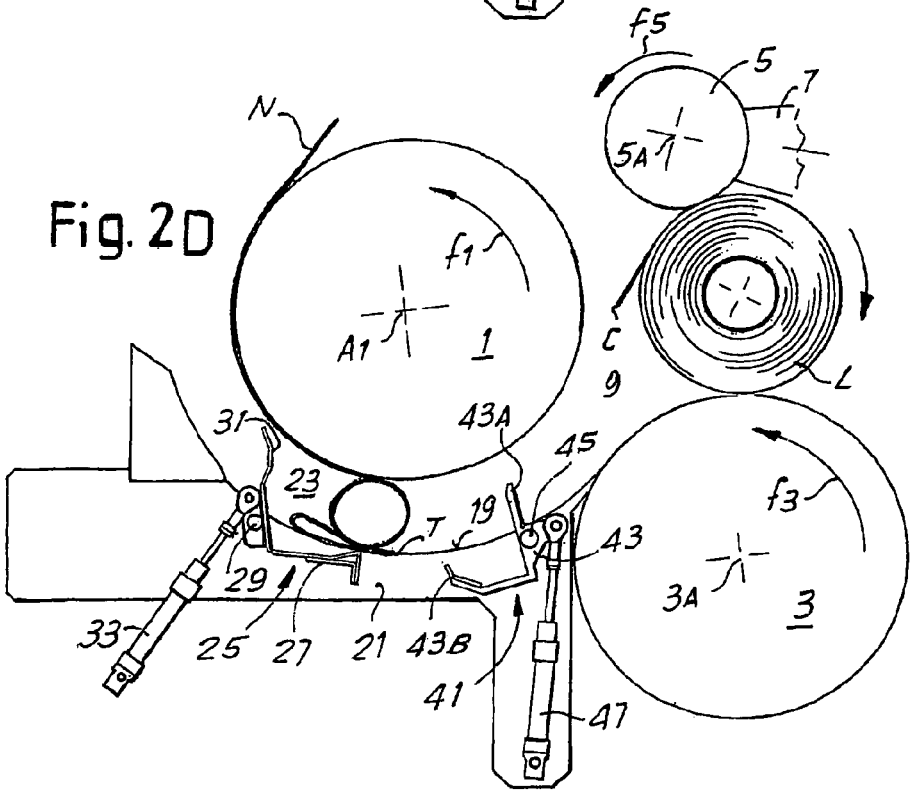
Figure 2E:
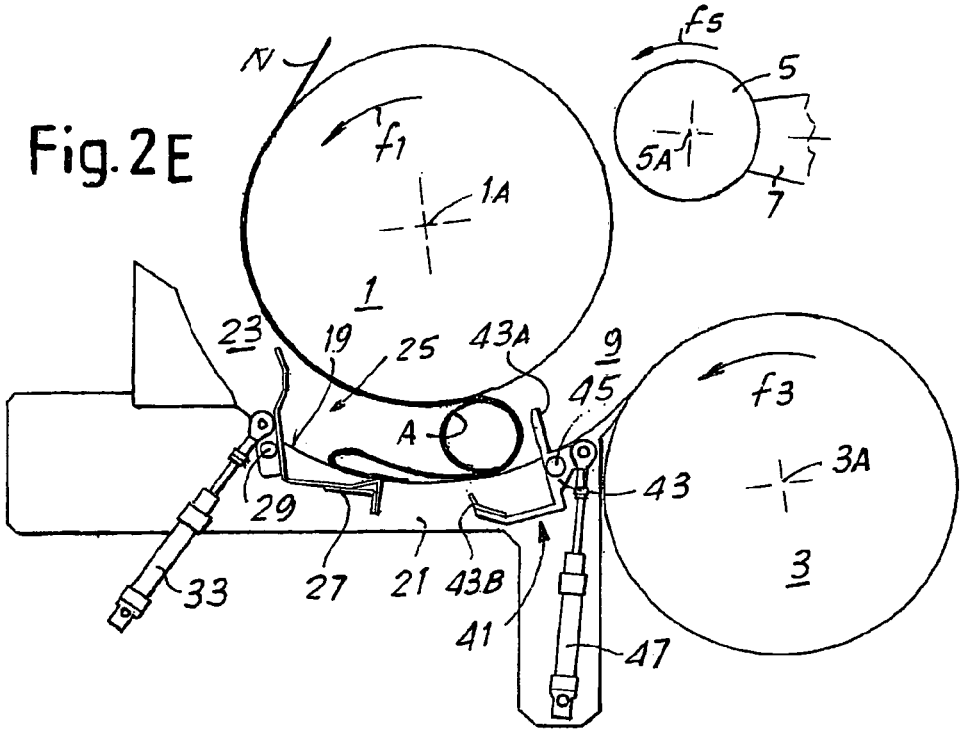
Figure 2F:
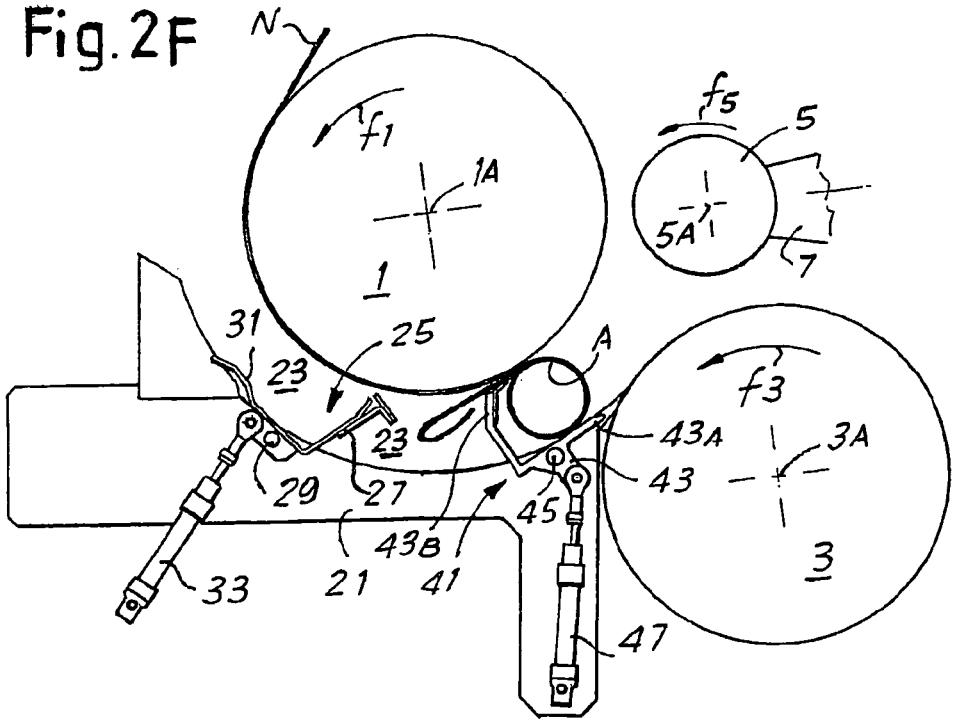

In the idle position in FIG. 1A the upper ends of the pressers 27 (if necessary coated with a yielding material and/or with a high coefficient of friction) are at a certain distance, e.g. a few millimeters or a few centimeters, from the web material N which is fed in contact with the guide member 13 in a position opposite the counter element 17. Above the upper ends of the pressers 27 there can also be mounted rigid or semi-rigid plates to facilitate braking of the web material against the counter element 17 (FIG. 2A). Moreover, it would also be possible for the counter element 17 to have a cutting groove or counter blade; in this case the upper ends of the pressers 27, preferably with toothed profile, penetrate the groove and break the web material. This tearing system is particularly advantageous in the case of web material without transverse perforation lines, usually used for tearing upon completion of winding.

Downstream of the separator device 25 there is disposed a movable mechanical member 41 intended to form or facilitate forming of the first turn of web material around each winding core that is fed towards the winding area along the channel 23. This movable mechanical member 41 has the shape shown in FIG. 3 limited to a portion of the member. In substance, the member 41 is formed of a plurality of brackets 43 hinged around an axis 45 oriented at approximately 90° with respect to the direction of feed of the web material N and therefore approximately parallel to the oscillation axis 29 of the separator device 25 and to the axes 15A, 1A, 3A and 5A of the rollers 15, 1, 3 and 5.

Each bracket 43 has a projection 43A which, in non-operating or idle conditions, projects as shown in FIG. 1A inside the channel 23. Besides the projection 43A, each bracket 43 has a curved arm 43B which, in the example shown, is formed by three rectilinear lengths at an angle from one another, but which could also take a curved shape or be formed by a smaller number of rectilinear lengths at an angle from one another, or also by a sequence of rectilinear and curvilinear lengths.

Preferably each bracket 43 is associated with a member that maintains said bracket in an idle position shown in FIG. 1A. In the example shown in FIGS. 1A-1F, 4 said member is constituted by a piston-cylinder actuator 47, although it would also be possible to use different members, such as a mechanical spring, a member for movement and angular control of the movable member 41 in synchronism with the movement of the core or even simply a counterweight. The counterweight can be constituted by a suitably dimensioned portion of said movable member 41, for example the portion 43B.

The machine described above operates in the manner illustrated hereunder with reference to the sequence in FIGS. 1A to 1F. FIG. 1A shows a conclusive step of winding a log L in the winding cradle formed by the three winding rollers 1, 3 and 5. A new winding core has not yet been inserted in the channel 23.

Figure 1B:
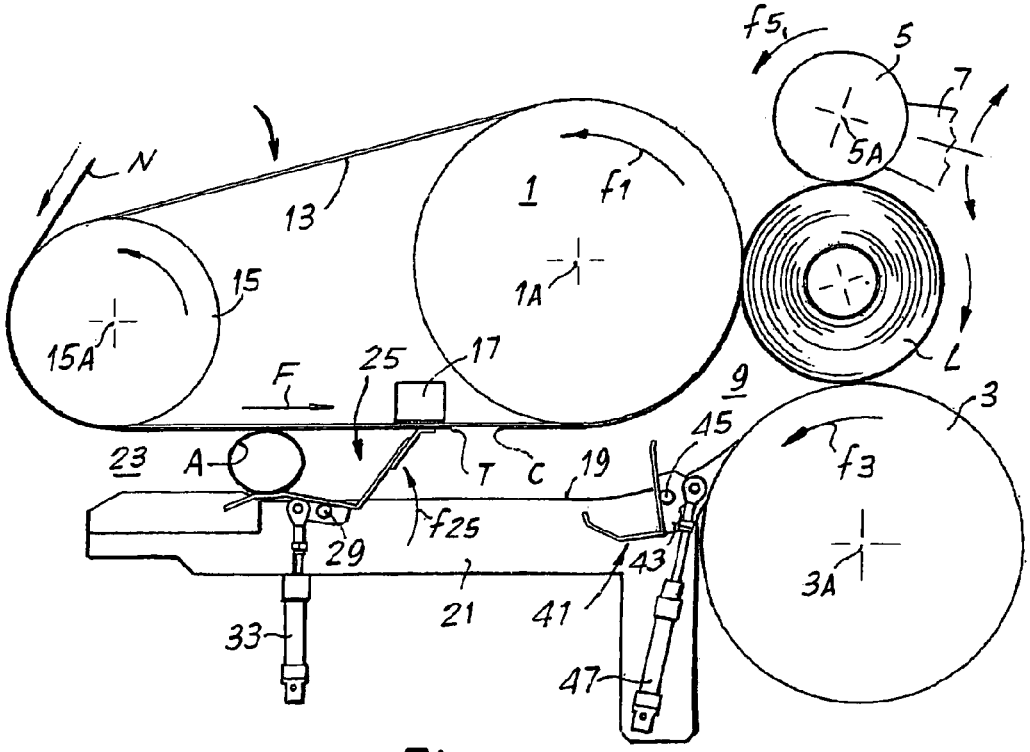

FIG. 1B shows the subsequent step, in which the subsequent winding core A has been inserted into the channel 23 by means of an inserting member of a type known per se and not shown. The winding core A, for example made of cardboard, plastic or another yielding material, is forcedly introduced into the channel 23 of a lesser height than the external diameter thereof so that it comes into contact under pressure with the rolling surface 19 and with the web material N fed around the roller 15 and in contact with the guide member 13. Consequently, the core A accelerates angularly taking in the point of contact with the web material N a speed substantially the same as the feed speed of the web material N, with possible negligible slipping.

The core A rolls along the rolling surface 19 following an insertion path that extends inside the channel 23. During this movement the core A encounters (FIG. 1B) the projections 31 of the brackets forming the separator device 25. As these projections 31 project inside the channel 23, travel of the core A causes a downward thrust of the projections 31 that are located (with respect to the direction of feed of the core) upstream of the point of oscillation 29. This causes oscillation in a counter-clockwise direction (in the figure) according to the arrow f25 of the separator device 25. The upper ends of the pressers 27 of the separator device 25 thus press against the web material N pinching it between the bent upper ends of the pressers 27 and the counter member 17 (if necessary coated with a yielding material and/or with high friction) located on the opposite side of the web material N. Advantageously, the pressers 27 can act between parallel and spaced belts forming the guide member 13 so that the web material N is pinched between the upper bent projections of the pressers 27 and the counter member 17, which is preferably fixed. The counter-clockwise oscillating movement 25 thus causes the web material N to stop or even a slight movement in the opposite direction with respect to the direction of feed. As a consequence of this, the web material is torn along one of the perforation lines generated by a perforator, not shown, thus forming a final free edge C which will complete winding on the log L and an initial free edge T that must start to be wound around a new winding core A (FIG. 1B).

Figure 1C:
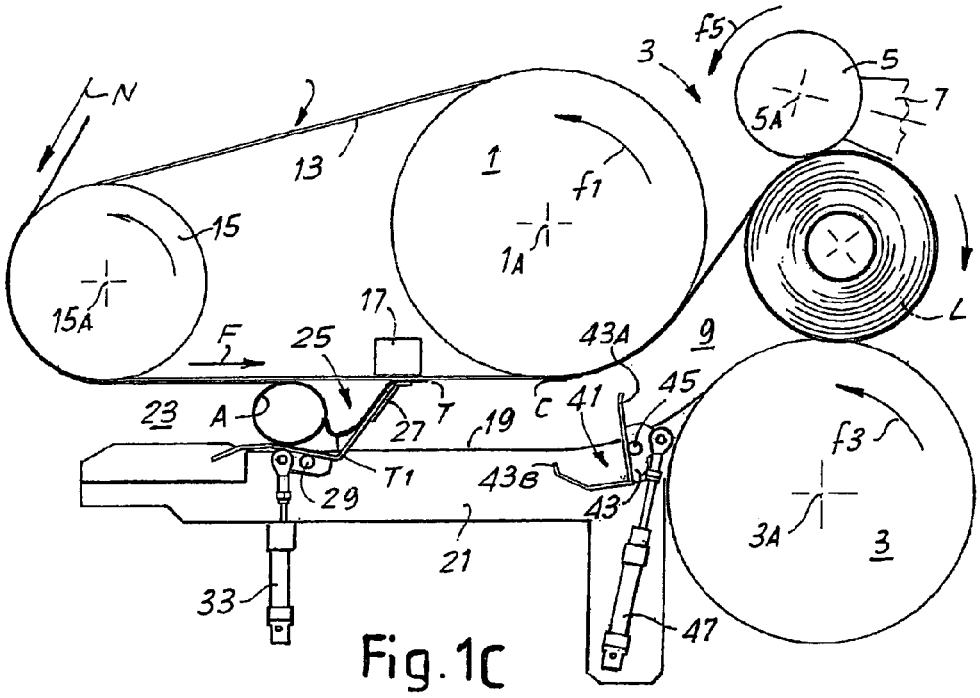

FIG. 1C shows a subsequent step, in which the winding core A is rolling along the channel 23 towards the pressers 27 and an initial portion T1, adjacent to the initial free end T, of the web material N is forming a loop between the new winding core A and the pressers 27 of the separator device 25. To facilitate winding of the first turn of web material around the winding core T1 there can be used means known to those skilled in the art, such as jets of air or suction, electrostatic or other means.

Continuing to travel by rolling along the channel 23, the winding core A comes into contact with the pressers 27 and, as a result of the rolling imparted by the guide member 13 (which also constitutes the feed member of the winding cores along the insertion path), exerts a thrust on the pressers 27. Consequently, these are withdrawn under the rolling surface 19 overcoming the force of the return member 33. This allows the core A to travel beyond the separator device 25 rolling over the loop of web material T1 FIG. 1D).

Figure 1D:
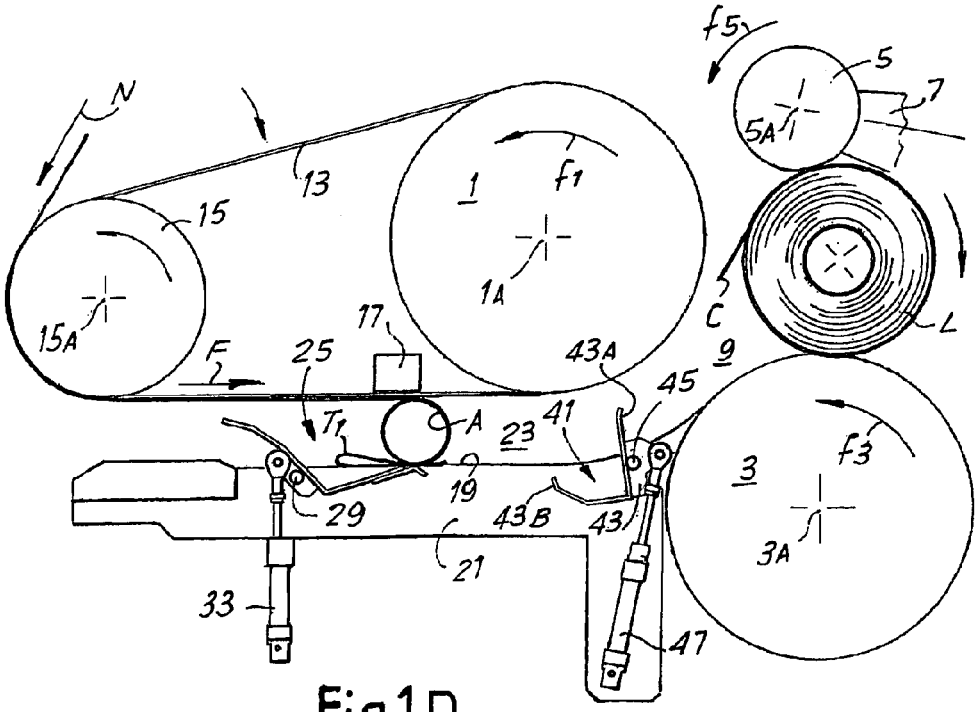
Figure 1E:
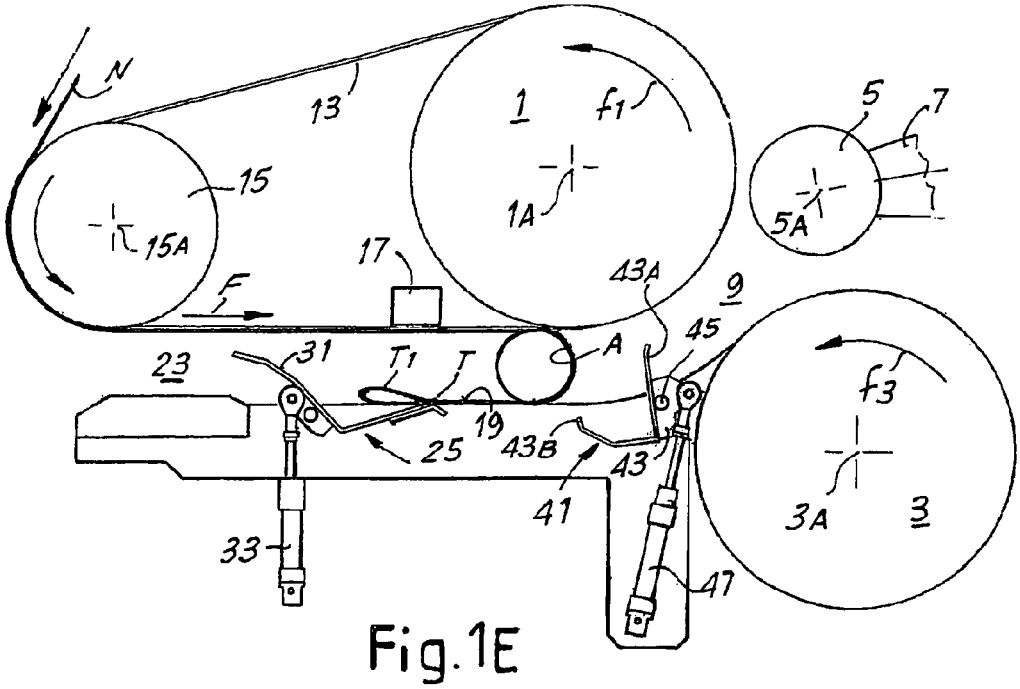

FIG. 1E shows a subsequent step in which the winding core A is even further forward with respect to the position in FIG. 1D and is wrapped through 180° by the web material N that continues to be fed along the guide member 13 and continues to form an increasingly long length of web material T1 adjacent and subsequent to the initial edge T, said length T1 resting on the rolling surface 19 or being slightly raised by return to the idle position of the pressers 27 of the separator device 25 under the pull of the return member 33.

Figure 1F:
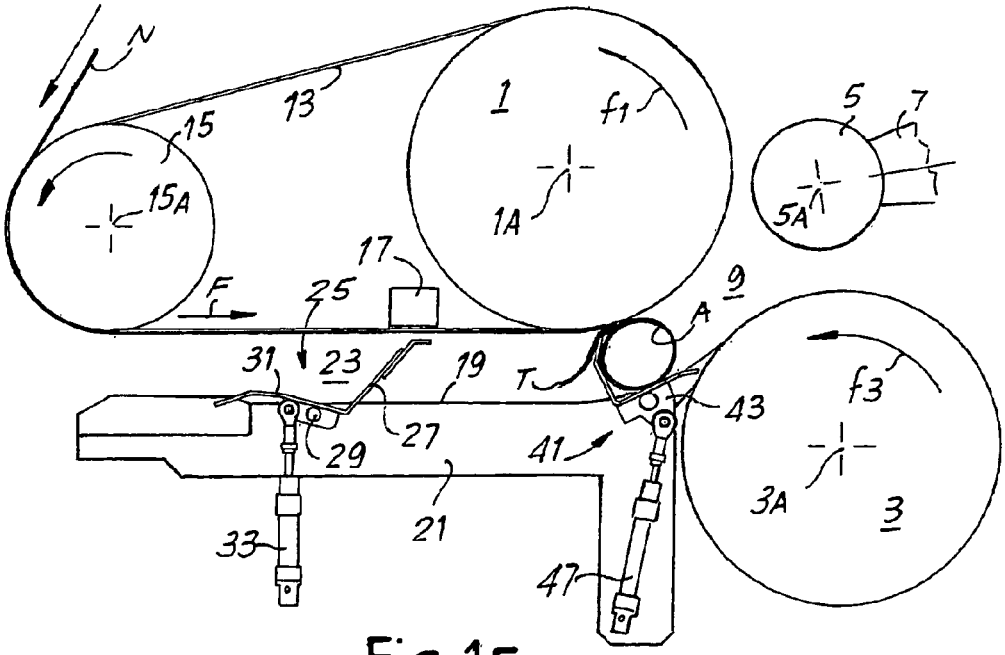

In the subsequent FIG. 1F the core A is moved even further forward to encounter the projections 43A of the movable mechanical member 41 which, as a result of the thrust of the core that rolls on the surface 19, are withdrawn under the rolling surface 19, consequently causing, against the effect of the counteracting member 47, raising of the curved arms 43B which, due to their shape, embrace from behind the core A that is rolling and raise thereagainst the edge T1 of web material that is positioned upstream of the pressure point between the core A and the rolling surface 19. This oscillatory movement of the arms 43B causes closing, or completion of the first turn of web material around the new winding core A.

In substance, the distal ends of the arms 43B are shaped and dimensioned so as to push the edge T1 of web material N in the area in which the web material is in contact with the winding roller 1 and tangent to the winding core A. Continuation of rolling of the core along the surface 19 and then in contact with the winding roller 3 completes insertion of the core through the nip 9 and takes this core into the winding cradle 1, 3, 5 where the new log continues to be formed and to increase in a manner known per se around the new winding core A.

From the description above it is understood how the use of the members 25 and 41 radically simplify the structure of the machine with respect to prior art rewinding machines both as regards severing of the web material and as regards the start of winding the initial free end on each new core A. Severing and forming of the first turn of web material around the new core both take place as a result of interaction between the winding core and mechanical devices which can be devoid of actuators making it unnecessary to power the respective motors and also to synchronize them with the other machine members, in particular the core inserter. It would also be possible to replace both or only one of the return members 33 and 47 with an actuator, such as a movement and control member in synchronism with the movement of the core. Nonetheless, the embodiment described above is more advantageous due to elimination of these actuator mechanisms.

The representation in FIGS. 1A-1F shows all the possible advantages obtainable by the invention. In fact, the movable mechanical member 41 avoids the need for any further measures to fasten the web material, or more specifically the initial portion thereof adjacent to the initial free edge T, to the new winding core at each machine cycle. The core can remain without glue and does not require to be electrostatically charged. Compressed air nozzles to facilitate or complete winding of the first turn of web material around the new winding core are not required either, thereby reducing consumption, noise, increasing the reliability and reducing the cost of the machine.

It must be understood that the separator device 25 can also be used in the absence of the mechanical member 41 and combined with other and different systems to start winding the web material N on the new core. For example, the separator device 25, preferably of passive type, i.e. represented by a mechanical element oscillating as a result of the thrust of the new core inserted in the insertion path, can be combined with a system to glue the cores, or to glue the free edge. Otherwise, an electrostatic, suction or blowing system can be used to start winding the first turn, although the mechanical device 41 is more advantageous for the reasons set forth previously.

Conversely, the mechanical member 41 can also be used in combination with systems for severing or separating the material of a different type with respect to the one shown in FIGS. 1A-1F.

FIGS. 2A to 2F show a different embodiment of the rewinding machine according to the invention. The same numbers indicate parts that are the same or equivalent to those of the previous embodiment shown in FIGS. 1A to 1F.

In the example of embodiment shown in FIGS. 2A to 2F, the assembly of belts forming the guide member 13 and consequently also the return roller 15, are missing. The channel 23 is formed in this case between the rolling surface 19, again formed by a series of adjacent sections 21 extending in the direction of longitudinal extension of the channel 23, and the external cylindrical surface of the winding roller 1. In this case this forms the movable guide member of the web material N.

The separator device 25 and the movable mechanical member 41 for forming or completing the first turn of web material around the new winding core A are produced and operate as described with reference to FIGS. 1A-1F. The operating sequence can be easily understood on the basis of the above description with reference to FIGS. 1A-1F and observing the sequence 2A-2F, without the need for further detailed descriptions.

It is understood that the drawing only shows an example given by way of a practical demonstration of the invention, as said invention can vary in forms and arrangements without however departing from the scope of the concept underlying the invention. Any reference numbers in the appended claims are provided to facilitate reading of the claims with reference to the description and to the drawing, and do not limit the scope of protection represented by the claims.

The invention claimed is:

1. A method for producing logs of web material around winding cores comprising:

upon completion of winding a log, severing the web material by a separator device to form a final edge, winding said final edge around said log, and winding an initial edge around a new winding core, wherein along an insertion path for a new winding core, a mechanical control element associated with said separator device is provided for controlling the separator device in relation to movement of said new winding core;

making said new winding core interact with said mechanical control element during feed of the winding core along said insertion path causing said separator device to move in said insertion path while said new winding core is advancing along said insertion path to cause said new winding core to continue movement in the insertion path and to cause said severing of the web material.

2. A method for producing logs of web material around winding cores comprising:

upon completion of winding a log, severing the web material by a separator device to form a final edge, winding said final edge around said log, and winding an initial edge around a new winding core, wherein in a position along an insertion path for a new winding core, a sensor element associated with said separator device is provided;

advancing said new winding core along said insertion path and making said new winding core interact with said sensor element during advancement of said rewinding core along said insertion path to generate a signal which activates said separator device and causes said severing of the web material when the core is advancing along said path and is in correspondence to said position of said sensor element along the insertion path.

3. The method as claimed in claim 1 or 2, wherein after said severing of the web material, continued feed of said new winding core causes temporary withdrawal of said separator device from the insertion path to allow passage of said new winding core.

4. The method as claimed in claim 1, further comprising:

providing a rolling surface for said winding cores;

providing a movable guide member for said web material, said guide member and said rolling surface defining an insertion channel for the winding cores and said web material being fed in contact with said guide member;

upon completion of winding a log, inserting a new winding core in said channel in contact with said web material and with said rolling surface;

feeding said new winding core along said channel;

making said new winding core interact with said separator device along said channel.

5. The method as claimed in claim 4, wherein said new winding core, interacting with said separator device, thrusts the separator device against the web material pinching the web material between the separator device and said guide member.

6. The method as claimed in claim 5, wherein continuation of movement of said new winding core along said channel subsequent to said severing of the web material causes temporary withdrawal of the separator device from the channel.

7. The method as claimed in claim 4, wherein the separator device causes perforation of the web material.

8. The method as claimed in claim 1 or 2, wherein said separator device is rotatingly supported about an axis of oscillation and wherein said new winding core during passage thereof causes oscillation of the separator device against the web material.

9. The method as claimed in claim 8, wherein said new winding core causes oscillation of the separator device to withdraw the separator device from the insertion path of said new winding core.

10. The method as claimed in claim 8, wherein said separator device oscillates about an axis substantially parallel to an axis of the new winding core that interacts with said separator device.

11. The method as claimed in claim 1 or 2, wherein said separator device is elastically stressed in an idle position, and wherein passage of said new winding core causes stressing of said separator device in an active position, in which said separator device acts on the web material causing severing thereof.

12. The method as claimed in claim 1 or 2, wherein said separator device is moved from an idle position to an operating position by passage of a core along the insertion path, the separator device acting on the web material causing severing thereof in said operating position.

13. The method as claimed in claim 1 or 2, further comprising:

feeding the web material along a feed path;

inserting said new winding core along the insertion path and in contact with said web material;

during feeding of said new winding core along said insertion path, and making said new winding core interact with said separator device causing activation of said separator device which acts on the web material downstream of said new winding core along the feed path causing severing of the web material.

14. The method as claimed in claim 13, further comprising continued feeding of the new winding core further along said insertion path causing temporary withdrawal of said separator device from the insertion path to allow passage of the new winding core.

15. A rewinding machine for producing logs of web material wound around winding cores, comprising:

a winding unit;

a web material feed path;

a winding core insertion path;

a separator device to sever the web material upon completion of winding each log;

wherein said separator device is provided with a mechanical control element which partly projects into said winding core insertion path to interact with said winding core when said winding core is moving in said insertion path such that said winding core forces said mechanical control element to cause activation of said separator device and consequently severing of the web material when the winding core is moving along said winding core insertion path.

16. A rewinding machine for producing logs of web material wound around winding cores, comprising:

a winding unit;

a web material feed path;

a winding core insertion path;

a separator device to sever the web material upon completion of winding each log; and a sensor arranged in a position along the winding core insertion path, and an actuator structured to control the separator device, said sensor structured to generate an activation signal for the actuator during passage of said winding core in correspondence to said position along said winding core insertion path, wherein said winding core causes said sensor to generate said signal during said passage to activate said separator device to cause severing of the web material.

17. The machine as claimed in claim 16, wherein said activation signal causes activation of the separator device to control withdrawal of the separator device with respect to the winding core insertion path to allow passage of the winding core free of interference with the separator device.

18. The machine as claimed in claim 15 or 16, wherein said separator device is supported around an oscillation axis, passage of said winding core in said insertion path causing oscillation of said separator device.

19. The machine as claimed in claim 15, wherein said separator device is constructed and arranged to take an idle position and an operating position in which the separator device acts on the web material to cause severing of the web material.

20. The machine as claimed in claim 19, wherein said separator device is stressed in an idle position by a mechanical or pneumatic return element, passage of the winding core causing movement of said separator device against action of said mechanical or pneumatic return element towards an operating position.

21. The machine as claimed in claim 19, wherein said separator device is constructed and arranged to take a withdrawn position in which the separator device allows passage of the winding core.

22. The machine as claimed in claim 21, wherein said separator device is stressed in said idle position by a mechanical or pneumatic return element, passage of the winding core causing movement of said separator device against action of said mechanical or pneumatic return element towards an operating position and wherein said mechanical or pneumatic return element stresses said separator device in an intermediate position between said operating position and said withdrawn position.

23. The machine as claimed in claim 15, wherein said separator device includes control projections constructed and arranged to interact with said winding core when said winding core moves along the insertion path, interaction with said winding core causing activation of the separator device.

24. The machine as claimed in claim 15 further comprising:

a guide member for the web material, disposed along said feed path, the web material being fed in contact with said guide member;

a rolling surface for said winding core;

wherein said guide member and said rolling surface define an insertion channel for said winding core; and said separator device is constructed and arranged to act on the web material in an intermediate position along said channel.

25. The machine as claimed in claim 24, wherein with respect to a direction of feed of the winding core in said channel, a mechanical element is disposed upstream of an element of said separator device acting in combination with said web material.

26. The machine as claimed in claim 24, wherein said separator device is supported around an oscillation axis substantially orthogonal to the direction of feed of the winding core along said channel.

27. The machine as claimed in claim 26, wherein said oscillation axis is positioned outside said channel on a side of said rolling surface.

28. The machine as claimed in claim 24, wherein said separator device comprises a plurality of pinchers which, when said separator device is activated by passage of the winding core, are structured to be pressed against the web material.

29. The machine as claimed in claim 24, wherein said rolling surface is defined by a plurality of sections arranged side-by-side and spaced from one another, extending along said channel, and wherein said separator device is projectible into said channel between adjacent sections.

30. The machine as claimed in claim 29, wherein said separator device comprises a plurality of pinchers which, when said separator device is activated by passage of the winding core, press against the web material and extend between adjacent sections.

31. The machine as claimed in claim 15, wherein said separator device comprises a blade structured to perforate the web material.

32. A method for producing logs of web material around winding cores comprising:

winding a first log of web material in a winding cradle;

upon completion of said winding of said first log, feeding a new winding core towards said winding cradle;

making said new winding core, through its feeding motion during passage towards the winding cradle, push a separator device to cause said separator device to sever the web material to form a final edge which is wound on said first log and an initial edge;

winding a second log of web material around said new winding core.

33. A rewinding machine comprising in combination:

a winding cradle;

a web material feed path towards said winding cradle;

a winding core insertion path towards said winding cradle;

a separator device to sever the web material upon completion of winding a log;

wherein the separator device is arranged along said winding core insertion path and partly projects inside said winding core insertion path, said separator device being constructed and arranged to co-act with winding cores during passage thereof along said insertion path such that passage of the winding cores along said insertion path pushes the separator device to cause severing of the web material.

* * * * *